US006855186B2

(12) United States Patent
Rao et al.

(10) Patent No.: US 6,855,186 B2
(45) Date of Patent: Feb. 15, 2005

(54) PROCESS FOR THE PRODUCTION OF NEODYMIUM-IRON-BORON PERMANENT MAGNET ALLOY POWDER

(75) Inventors: Patcha Ramachandra Rao, Jharkhand (IN); Venkatesh Rao, Jharkhand (IN); Arvind Singh, Jharkhand (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/393,387

(22) Filed: Mar. 20, 2003

(65) Prior Publication Data

US 2003/0217620 A1 Nov. 27, 2003

(30) Foreign Application Priority Data

Apr. 8, 2002 (IN) ..... PCT/IN02/00104

(51) Int. Cl.[7] ..... B22F 1/00; C21B 15/04

(52) U.S. Cl. ..... 75/371; 148/349; 148/351; 148/370

(58) Field of Search ..... 75/348, 349, 351, 75/370, 371; 148/302; 420/83, 121

(56) References Cited

U.S. PATENT DOCUMENTS

| | | | | | |
|---|---|---|---|---|---|
| 4,715,890 | A | * | 12/1987 | Ovshinsky et al. | 148/105 |
| 4,983,217 | A | * | 1/1991 | Lopez Quintela et al. | 75/739 |
| 5,062,888 | A | * | 11/1991 | Watanabe | 75/739 |

FOREIGN PATENT DOCUMENTS

| | | | | |
|---|---|---|---|---|
| DE | 3621530 | * | 7/1988 | 75/347 |
| JP | 3-27502 | * | 2/1991 | 75/349 |

* cited by examiner

*Primary Examiner*—John P Sheehan
(74) *Attorney, Agent, or Firm*—Ladas & Parry LLP

(57) ABSTRACT

The present invention relates to an improved process for the production of neodymium-iron-boron permanent magnet alloy powder. The neodymium-iron-boron alloy prepared by the process of the present invention can be processed further to get anisotropic permanent magnets, bonded as well as sintered.

13 Claims, No Drawings

PROCESS FOR THE PRODUCTION OF NEODYMIUM-IRON-BORON PERMANENT MAGNET ALLOY POWDER

FIELD OF THE INVENTION

The present invention relates to an improved process for the production of neodymium-iron-boron permanent magnet alloy powder. The neodymium-iron-boron alloy prepared by the process of the present invention can be processed further to get anisotropic permanent magnets, bonded as well as sintered.

BACKGROUND OF THE INVENTION

Neodymium-iron-boron magnets find wide application due to their excellent magnetic properties, viz. a very high coercivity, a high remanence and a very high maximum energy product. They are increasingly used in motors, generators, measuring and control devices, telecommunications, acoustic devices and magneto-mechanical applications. They also find applications in aerospace components, instrumentation, medical diagnosis and treatment.

In conventional methods of production of neodymium-iron-boron magnets, the individual elements such as neodymium, iron and boron or ferroboron are melted crushed and milled to micron size, compacted under magnetic field and then sintered. This known process is energy intensive as well as costly. The rare earth metal, neodymium which is the raw material for the process is very expensive because of the difficulties in the separation of neodymium oxide/salt from the mixture of rare earth oxides/salts and the reduction of neodymium oxide/salt into metal. In another known process wherein metallothermic reduction diffusion is involved, neodymium chloride/fluoride or oxide, iron and boron or ferroboron are reacted with calcium in the presence of hydrogen to get neodymium-iron-boron alloy along with calcium oxide and unreacted calcium. This is further reacted with water/moist nitrogen to remove calcium and then leached with acetic acid to remove calcium oxide. This process also requires considerable amount of energy input in preparation of alloy during reduction with calcium at high temperature in the range of 1000 to 1200° C.

Indian patent application No. 374/Del/94 dated 31.03.94, discloses a process for the production of nano sized neodymium-iron-boron permanent magnet alloy powder. The process employs neodymium oxide/salt, iron salt and borohydride for making neodymium-iron-boron alloy powder with particle size in the range of 20–100 nm (nm: nanometer). The use of borohydride as a reductant helps in the reduction of neodymium and iron salt to their metallic state and formation of the compound is accomplish through suitable heat treatment. The as produced powder being highly pyrophoric needs specific surface treatment to stabilize it. However, this coating some times leads to problems when the powder is subjected to further heat treatment.

Prior art methods also require several steps for the manufacture of neodymium-iron-boron permanent magnet alloy powder and are time consuming. Neodymium-iron-boron alloy with a characteristic microstructure and phase as required for the production of permanent magnet which are not achieved by the prior art processes enumerated above. Prior art processes also require high temperature treatment thereby increasing the energy costs in the manufacture of neodymium-iron-boron alloy.

OBJECTS OF THE INVENTION

The main object of the invention is to provide a process for production of neodymium-iron-boron permanent magnet alloy powder which overcomes the above mentioned drawbacks.

It is another object of the invention to provide Neodymium-iron-boron alloy in a two step process thereby saving on time and cost in the manufacturing.

It is another object of the invention to provide a process for the manufacture of Neodymium-iron-boron alloy with a characteristic microstructure and phase as required for the production of permanent magnet.

It is another object of the invention to provide a process for the manufacture of neodymium-iron-boron powders with compositions and phases at much lower temperature than that required by any other known processes.

It is another object of the invention to provide a process for the manufacture of neodymium-iron-boron powders where the cost of production is far less compared to the existing processes which involves melting the milling or metallothermic reduction.

SUMMARY OF THE INVENTION

Accordingly, the present invention provides an improved process for the production of neodymium-iron-boron permanent magnet alloy powder which comprises:

i). preparing neodymium salt solution of strength in the range of 0.25–2.0 M, iron salt solution of strength in the range of 0.25–2 M and alkali borohydride solution in the range of 1–5 M, ii). mixing the neodymium salt and iron salt solutions, prepared in step (i) and adjusting the pH of the solution in the range of 1.5–2.5, iii). adding the alkali borohydride solution, prepared in step (i) slowly and continuously to the mixture of neodymium-iron salt solution of step (ii) and maintaining at a temperature in the range of 5 to 15° C. with continuous stirring to get a black precipitate having a composition in the range of:

| | |
|---|---|
| Neodymium | 10 to 40 wt % |
| Iron | 60 to 90 wt % |
| Boron | 1 to 10 wt % |

iv). filtering and washing the precipitate, obtained from step (iii) with water and an organic solvent.

v). heat treating the precipitate at a temperature in the range of 500 to 750° C. to obtain the alloy of Nd—Fe—B.

In one embodiment of the invention the amounts of the solutions used are in the following range;

| | |
|---|---|
| Neodymium salt | 1 volume |
| Iron salt | 3–7 volumes |
| Alkali boronhydride | 4–10 volumes |

In another embodiment of the invention the salts used in step (i) are of commercial grade.

In another embodiment of the invention, the mixing of the neodymium and iron salt solutions with alkali borohydride is done in inert atmosphere.

In another embodiment of the invention, the mixing of the neodymium and iron salt solutions is done using argon or hydrogen.

In a further embodiment of the invention, the iron salt is ferrous sulphate and the neodymium salt is neodymium chloride.

In another embodiment of the invention the organic solvent used is selected from methanol, acetone and any mixture thereof.

DETAILED DESCRIPTION OF THE INVENTION

By the process of present invention a two phase material with grains of size 200–500 m with composition close to $Nd_2Fe_{14}B$ and grain boundary with composition close to $NdFe_{34}B_4$ is produced.

The process of the present invention differs from Indian patent application No. 374/Del/94 in the following way:

The process of the invention, with a heat-treatment schedule, using both hydrogen and argon at 750° C., provides a bulk alloy of Nd—Fe—B system with the required $Bd_2Fe_{14}B$ and $NdFe_4B_4$ phases, grain size being in the range of sub-micron. This heat treatment directly provides the optimum concentration of boron in the alloy, as the excess boron being driven away from the system in the form of volatile borohydrides.

The process of present invention employs a chemical route involving a reaction of neodymium oxide/salt, iron salt and a borohydride under specific conditions of concentration, pH, temperature and time for the reaction followed by a heat treatment at ambient temperature under controlled atmosphere for making neodymium-iron-born alloy. The use of borohydride as reductant helps in the reduction of neodymium and iron salts to their metallic state. The formation of alloy with optimum number of phases is accomplished through suitable heat treatment.

The process for the production of neodymium-iron-boron permanent magnet alloy powder comprises first preparing salt solutions of neodymium and iron of strength in the range of 0.25–2.0 M, and 0.25–2 M respectively, and alkali borohydride solution in the range of 1–5 M. The neodymium salt and iron salt solutions are then mixed and the pH of the resulting solution adjusted in the range of 1.5–2.5. The alkali borohydride solution is then added slowly and continuously to the mixture of neodymium-iron salt solution while maintaining at a temperature in the range of 5 to 15° C. with continuous stirring to get a black precipitate. The precipitate has a composition comprising Neodymium: 10 to 40 wt %; Iron: 60 to 90 wt % and Boron: 1 to 10 wt %.

The precipitate is then filtered and washed with water and an organic solvent such as methanol or acetone or a mixture thereof. The washed precipitate is then heat treated with hydrogen/argon at a temperature in the range of 500 to 750° C. to obtain the alloy of Nd—Fe—B.

The amounts of the solutions used are preferably in the following range;

| | |
|---|---|
| Neodymium salt | 1 volume |
| Iron salt | 3–7 volumes |
| Alkali boronhydride | 4–10 volumes |

All the salts used may be of commercial grade.

The mixing of the neodymium and iron salt solutions with alkali borohydride may be done in inert atmosphere preferably using argon.

By the process of present invention a two phase material with grains of size 200–500 m with composition close to $Nd_2Fe_{14}B$ and grain boundary with composition close to $NdFe_{34}B_4$ is produced.

The following examples are given by way of illustration and should not be construed to limit the scope of the present invention.

EXAMPLE-1

40 ml. of 1 M ferrous sulphate solution was mixed with 5 ml of 1 M neodymium chloride and cooled to 10° C. The pH of the solution was adjusted to 1.5. To this was added 100 ml of 4 M sodium borohydride solution with continuous stirring. The black precipitate forms was filtered, washed with water methanol and acetone. The powder was heat treated in pure argon at 150° C. and up to 700° C. in hydrogen. Sample was held at this temperature for 2 hours and then cooled in argon. The material as identified by SEM (EDX) and X-ray diffraction, indicated a mixture of two phases namely iron rich phase and neodymium rich phase.

The product was further tested for ensuring the presence of elements in their metallic forms. The result obtained are as follows:

Iron rich phase gave the following chemical analysis (By EDX(:

| | |
|---|---|
| Fe | 96.97 wt % |
| Nd | 3.03 wt % |

Neodymium rich phase gave the following chemical analysis (By EDX):

| | |
|---|---|
| Fe | 30.31 wt % |
| Nd | 69.96 wt % |

The boron was found to be 5 wt % in the alloy.

EXAMPLE-2

40 ml. of 1 M ferrous sulphate solution was mixed with 8 ml. of 1 M neodymium chloride and cooled to 10° C. The pH of the solution was adjusted to 1.5 to this was added 100 ml of 4 M sodium borohydride solution with continuous stirring. The black precipitate formed was filtered, washed with water, methanol and acetone. The powder was heat treated in pure argon at 150° C. and up to 700° C. in hydrogen. Sample was held at this temperature for 2 hours and then cooled in Argon. This material was further annealed in Argon for 96 hours. The material was identified by SEM (EDX) and x-ray diffraction, a mixture of two phases namely $Nd_2Fe_{14}B$ (Phase-I) and $NdFe_4B_4$ (Phase-II). The product was further tested for ensuring the presence of elements in their metallic forms. The result obtained are as follows:

Phase-I gave the chemical analysis (By EDX) as follows:

| | |
|---|---|
| Fe | 73.79 wt % |
| Nd | 26.21 wt % |

Phase-II gave the chemical analysis (By EDX) as follows:

| | |
|---|---|
| Fe | 58.73 wt % |
| Nd | 39.27 wt % |

The boron was found to be 2 wt % in the bulk alloy.

The main advantages of the present invention are:

a). Neodymium-iron-boron alloy is produced in two steps only whereas other relevant known processes require several steps and time consuming.

b). Neodymium-iron-boron alloy produced has characteristic microstructure and phase as required for the production of permanent magnet. This has not been achieved in known processes.

c). The required compositions and phases have been obtained by heat treating the very fine neodymium-iron-boron alloy (particle size in the range 20–80 nm) at, much lower temperature than that required by any other known processes.

d). The cost of production of the product of the present invention is far less compared to the existing processes which involves melting the milling or metallothermic reduction.

We claim:

1. A process for the production of neodymium-iron-boron permanent magnet alloy powder which comprises the following steps:

(i) preparing a neodymium salt solution with a strength in the range of 0.25–2.0 M, an iron salt solution with a strength in the range of 0.25–2 M and a alkali borohydride solution with a strength in the range of 1–5 M, (ii) mixing the neodymium salt and iron salt solutions using argon or hydrogen to form a mixed neodymium-iron salt solution and adjusting the pH of the mixed solution in the range of 1.5–2.5, (iii) adding the alkali borohydride solution slowly and continuously to the neodymium-iron salt solution of step (ii) in inert atmosphere and maintaining at a temperature in the range of 5 to 15° C. with continuous stirring to get a black precipitate having a composition comprising:

| | |
|---|---|
| Neodymium | 10 to 40 wt % |
| Iron | 60 to 90 wt % |
| Boron | 1 to 10 wt % |

(iv) filtering and washing the precipitate with water and an organic solvent, and (v) heat treating the precipitate at a temperature in the range of 500 to 750° C. to obtain the alloy of Nd—Fe—B.

2. A process as claimed in claim 1, wherein the respective solutions comprise:

| | |
|---|---|
| Neodymium salt | 1 volume |
| Iron salt | 3–7 volumes |
| Alkali boronhydride | 4–10 volumes. |

3. A process as claimed in claim 1, wherein the respective solutions comprise salts of commercial grade.

4. A process as claimed in claim 1, wherein the iron salt is ferrous sulphate and the neodymium salt is neodymium chloride.

5. A process as claimed in claim 1, wherein the organic solvent is selected from the group consisting of methanol, acetone and any mixture thereof.

6. A process as claimed in claim 1, wherein the process consists essentially of steps (i), (ii), (iii), (iv) and (v).

7. A process for the production of neodymium-iron-boron permanent magnet alloy powder which comprises the steps of:

(i) providing a solution consisting essentially of neodymium salt in a strength of 0.25–2.0 M, a solution consisting of iron salt in a strength of 0.25–2 M and a solution of an alkali borohydride in a strength of 1–5 M;

(ii) mixing the neodymium salt solution with the iron solution to obtain a mixed neodymium-iron salt solution and adjusting the pH of the mixed solution to a range of 1.5–2.5;

(iii) adding the alkali borohydride solution to the mixed neodymium-iron salt solution slowly and continuously to form a resultant solution and maintaining the resultant solution at a temperature in a range of 5 to 15° C. with continuous stirring to form a black precipitate;

(iv) recovering the precipitate; and (v) heat treating the precipitate in the presence of argon and hydrogen to form a two phase alloy powder of neodymium-iron-boron comprising 10 to 40 wt % neodymium, 60 to 90 wt % iron and 1 to 10 wt % boron.

8. The process as claimed in claim 7, wherein the resultant solution consists essentially of the neodymium salt, the iron salt, the alkali borohydride and a solvent.

9. The process as claimed in claim 7, wherein the mixing in step (ii) is performed using argon or hydrogen.

10. The process as claimed in claim 9, wherein the mixing in step (iii) is performed in inert atmosphere.

11. The process as claimed in claim 7, wherein the heat treatment comprises a first treatment in argon and a subsequent treatment in hydrogen.

12. The process as claimed in claim 11, wherein the temperature in the heat treatment does not exceed 750° C.

13. The process as claimed in claim 12, wherein the process consists essentially of said steps (i), (ii), (iii), (iv) and (v).

* * * * *